US005308677A

United States Patent [19]

Renna

[11] Patent Number: 5,308,677

[45] Date of Patent: May 3, 1994

[54] PACKAGE STUFFING

[76] Inventor: Douglas Renna, 131 Munro Blvd., Valley Stream, N.Y. 11581

[21] Appl. No.: 940,549

[22] Filed: Sep. 4, 1992

[51] Int. Cl.[5] ..... B32B 1/00

[52] U.S. Cl. ..... 428/174; 428/179; 428/182; 428/537.7; 206/584; 206/814; 493/967

[58] Field of Search ..... 428/156, 172, 119, 120, 428/174, 178, 179, 182, 192, 155, 124, 130, 537.7; 493/967; 206/814, 584

[56] References Cited

U.S. PATENT DOCUMENTS 4,791,773 12/1988 Taylor ..... 428/69

*Primary Examiner*—Donald J. Loney

*Attorney, Agent, or Firm*—Bauer & Schaffer

[57] ABSTRACT

Geometrically shaped bodies comprising a flat base having arcuate or geometrically shaped cross section from one face of which extend projections having a reverse arc or shape to that of the base below each of which is a cutout or slot.

4 Claims, 1 Drawing Sheet

FIG. 2
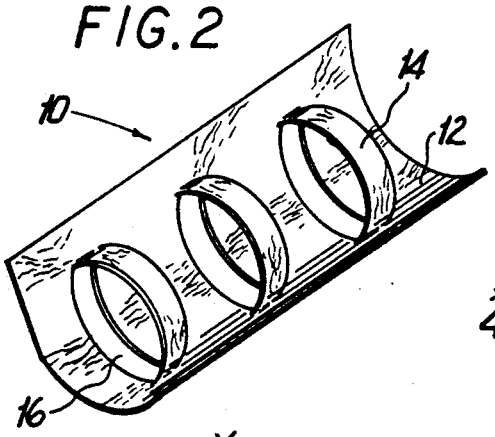
FIG. 3
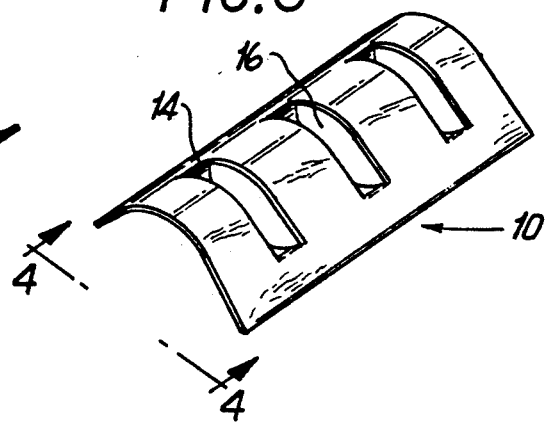
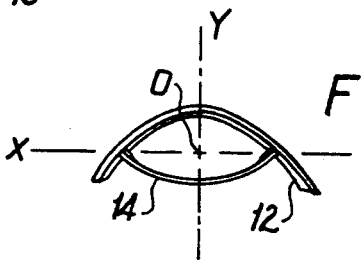
FIG. 4
FIG. 1
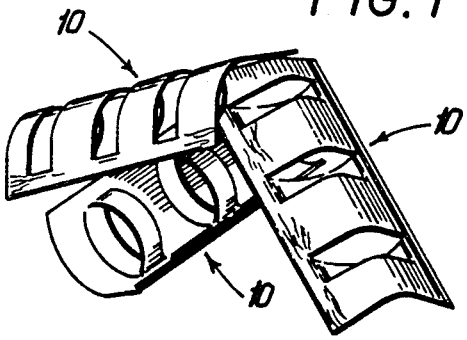
FIG. 6
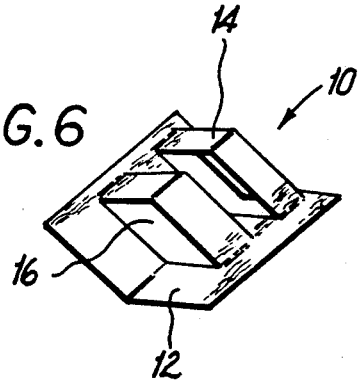
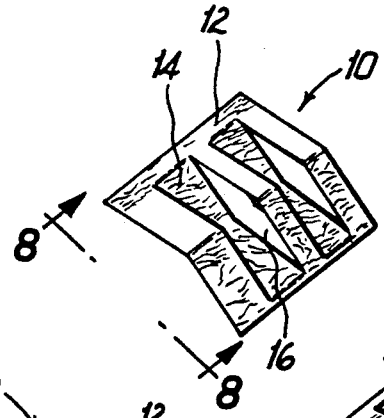
FIG. 7
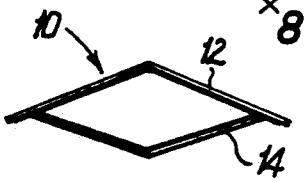
FIG. 8
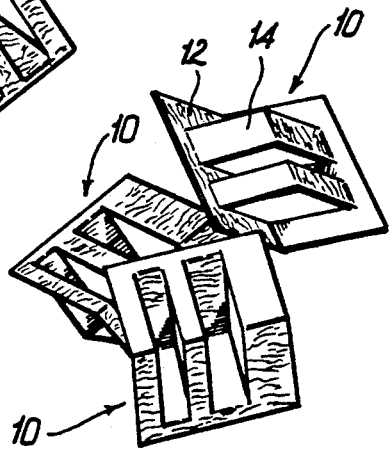
FIG. 5

PACKAGE STUFFING

BACKGROUND OF INVENTION

The present invention relates to packaging materials and in particular to material used to stuff and fill shipping cartons and crates to protect small, valuable or fragile articles.

It will of course be recalled that it was common to use newspaper and/or excelsior material to wrap and embed small, valuable and fragile articles in shipping cartons or crates. Such material was in fact unclean, being themselves basically waste products. In addition they required manual handling to insure proper stuffing. Recently, such material were replaced with shaped foam plastic boats into which the articles being shipped were securely held. Even more recently, foamed plastic pieces or "Peanuts" (so named because their shape resembled the edible variety) have become common.

Foamed plastic "Peanuts" had the advantage of being light in weight, and of relatively incompressible and undeformable during use. On the other hand foamed plastic "Peanuts" have considerable disadvantage in that they are more expensive than paper and are non-biodegradable. They thus create an environmental waste problem and health problem. Foamed plastic Peanuts are extremely difficult to handle because of their small size and light weight so their collection and disposal is rendered difficult. They also present a significant storage problem in that large masses must be kept on hand, pending their use.

It is an object of the present invention to provide packaging and stuffing material, useful as a substitute for the plastic peanut that avoids each of the foregoing disadvantages while retaining each of the advantages.

In particular, it is the intention of the present invention to provide packaging stuffers which are highly biodegradable, to therefore remove any threat to the environment.

It is another object of the present invention to provide "peanut" substitute which are more economical and easier to handle.

These objects as well as others will be apparent from the foregoing disclosure.

SUMMARY OF THE INVENTION

According to the present invention, there is provided package stuffing material comprising a plurality of substantially hollow bodies capable of filling a volume substantially greater than the sum of their individual volumes. The bodies are formed in an integral and unitary manner of an elongated base having a cross sectional shape from which a plurality of longitudinally spaced projections extend upwardly therefrom in a conforming reverse shape.

Preferably, the projections are in the nature of curved or dome like strips and may vary in width (in the lengthwise direction) to define with the base a generally hollow cylindrically or ovid shaped form. The juxtaposition of the base and projections create a truss arrangement which has considerable strength against compression and twist. When randomly placed within a container the bodies abut in such manner as to provide considerable space and interstices between them so as to significantly increase their overall volume.

Full details of the present invention are set forth in the following description and in the accompanying drawings.

BRIEF DESCRIPTION OF THE DRAWINGS

In the drawings:

FIG. 1 is a perspective view of the plurality of package stuffers illustrating their collective use;

FIG. 2 is a perspective view of a package stuffer of the present invention;

FIG. 3 is a perspective view of the package stuffer shown in FIG. 2;

FIG. 4 is an end view of the package stuffer taken in the direction 4—4; and FIGS. 5 to 8 are view of another embodiment of the present invention conforming respectively to each of FIGS. 1–4.

DESCRIPTION OF THE INVENTION

Turning now to the drawings, the package stuffers or packaging material of the present invention comprises a plurality of individual geometrically shaped hollow bodies, generally depicted by the numeral 10, which as seen in FIG. 1 occupy collectively a volume greater than the sum of their individual volumes.

Each of the bodies are preferably approximately 1 to 2 inches in length and between ½ to 1 inches in width, although the size is not critical and may vary as desired. Each body 10 comprises a flat base 12 having an arcuate or geometrically shaped cross-section, from one face of which extend projections 14 having a reverse arc or shape to that of the base. Below each projection there remains a slot 16 of comparable size to the projection and the projections 14 rise dome-like from the base 12 inwardly of the longitudinal side edges 18 leaving a small apron 20 running along each edge.

Preferably the width of the projection 14 (in the longitudinal direction) are not uniform thereby reducing, as seen in FIG. 1, the possibility of nesting when two or more bodies placed in the abutting relation.

The bodies 10 are generally symmetrical about orthognal planes X and Y passing through the longitudinal center 0. That is, the arcuate projections 14 have substantially the same radius of curvature or shape as that of the base thereby providing a longitudinal extending dome on both sides so that whether the body falls on its back or its front (however one choose to define them) it rests on an elongated dome surface. This opposing position of curved or shaped surfaces creates a truss structure in which the opposing parts reacting against each other provide a strengthened ovid structure.

The drawings illustrate two embodiments or forms in which the package stuffing may be made. In the embodiment of FIGS. 1–4 the body assumes a cylindrical cross-sectional shape, while in FIGS. 5–8 it assumes the cross-sectional shape of a modified parallelogram. While the cross sectional form may vary, it is critical that the entire unit be integrally formed and in the final version without score lines, bends or the like which might create weakening of the material.

Preferably, the bodies are formed by molding, that is the shape, projections, slots, etc., are all formed simultaneously and integrally in a single mold. The molding may be the only step in the shaping of the body, or it may be the final step in which a preceding step involves the cutting of the projections from a base sheet followed by the final molding step. Because ultimately each body is subjected to a form of molding each has a uniform thickness and density throughout and no score marks or mechanical working occurs to weaken any portion of the body. As a result, the strength of the basically hollow bodies is maintained, as is its stability. Above all, each body's arcuate strength against compression is enhanced by the opposing arcuate configuration of the base and the projections and the symmetry about the orthognal planes.

Preferably, the material from which the bodies 10 are formed consist of a bio-degradable paperboard one such material is described in my prior U.S. Pat. No. 5,096,650, the contents of which are incorporated herein as if more fully set forth. This material, containing a major portion of a cellulose and a minor portion of a uncured biodegradable latex polymer is unexpectedly beneficial in forming the bodies. As described in my prior patent such material can be molded to provide a stable form of rigid shape and still maintain its biodegradability. The material when formed can be provided with a uniform thickness and density so that it can be molded into the desired shape heretofore described and into relatively light weight bodies of an overall bulky volume. A further and more critical advantage lies in the fact that the material when molded has high compressive strength, torsion strength and retentive strength even when large masses are stuffed into shipping containers and crates and subject to the forces of shipment.

While the material described in U.S. Pat. No. 5,096,650 is highly desirable, other paperboard material can be used provided such material can be molded into retaining configuration shapes, be bio-degradable and have an ability to fill a volume substantially larger than that of the sum total volume of the individual bodies used.

It will be seen that from FIGS. 1 and 5 that the package stuffing of the present invention can be easily used in lieu of "Peanuts" or other package stuffing, by simply disposing a plurality of them within a container in random unoriented manner so that they lie helter-skelter in contact with each other. The small, value or fragile article may be easily nested or embedded in the mass of the package stuffing.

What is claimed is:

1. Package stuffing material comprising a plurality of discrete bodies of similar construction, each body being formed of adapted to fill a volume greater than the sum of rigid sheet material bent lengthwise to form a transversely shaped base, a plurality of spaced transverse projections having their ends integral with said base and extending away from said base in an opposite direction and in a conformingly transverse shape reverse to the shape of the base, each said body providing a substantially incompressible hollow form symmetrical about the orthogonal planes passing through the longitudinal central axis of said body, said plurality of bodies being capable of filling a volume greater than the sum of their individual volumes.

2. The package stuffing material according to claim 1 where said base and said projections are formed of conforming reverse arcs.

3. The package stuffing material according to claim 1 where said base and said projections are formed of reverse cross-sectional shapes.

4. The package stuffing material according to claim 1 wherein each said body is formed of a molded paperboard material.

* * * * *

UNITED STATES PATENT AND TRADEMARK OFFICE

CERTIFICATE OF CORRECTION

PATENT NO. : 5,308,677

DATED : May 3, 1994

INVENTOR(S) : Douglas Renna

It is certified that error appears in the above-identified patent and that said Letters Patent is hereby corrected as shown below:

Claim 1, lines 3-4: delete "adapted to fill a volume greater than the sum of"

Signed and Sealed this

Second Day of August, 1994

Bruce Lehman

*Attest:*

BRUCE LEHMAN

*Attesting Officer*

*Commissioner of Patents and Trademarks*